US006334494B1

(12) United States Patent
Nagato

(10) Patent No.: US 6,334,494 B1
(45) Date of Patent: Jan. 1, 2002

(54) CONTROL UNIT FOR HYDRAULIC IMPACT WRENCH

(75) Inventor: Atsushi Nagato, Osaka (JP)

(73) Assignee: Fuji Air Tools Co., Ltd. (JP)

( * ) Notice: Subject to any disclaimer, the term of this patent is extended or adjusted under 35 U.S.C. 154(b) by 0 days.

(21) Appl. No.: 09/594,373

(22) Filed: Jun. 15, 2000

Related U.S. Application Data

(63) Continuation of application No. PCT/JP99/00858, filed on Feb. 24, 1999.

(30) Foreign Application Priority Data

Oct. 15, 1998 (JP) ..... 10-313967

(51) Int. Cl.[7] ..... B25D 15/00; B25B 21/00
(52) U.S. Cl. ..... 173/93.5; 173/93; 173/177
(58) Field of Search ..... 173/93, 93.5, 93.6, 173/176, 177

(56) References Cited

U.S. PATENT DOCUMENTS 4,920,836 A * 5/1990 Sugimoto et al. ..... 173/93.5
4,967,852 A * 11/1990 Tatsuno ..... 173/93
5,080,181 A * 1/1992 Tatsuno ..... 173/93.5
5,217,079 A * 6/1993 Kettner et al. ..... 173/177
5,544,710 A * 8/1996 Groshans et al. ..... 173/176

* cited by examiner

*Primary Examiner*—Scott A. Smith
(74) *Attorney, Agent, or Firm*—Morrison Law Firm

(57) ABSTRACT

A pressure leading path in a impact type tool is branched halfway through a bypass passage for connecting a high pressure chamber H with a low pressure chamber (L). The branch includes a first fixed aperture leading to the high pressure chamber (H). The branch also includes a second fixed aperture leading to the low pressure chamber (H). The pressure leading path is connected to a primary side of a relief valve. An automatic shutoff mechanism is operated by hydraulic operating fluid relieved from the secondary side of relief valve. The automatic shutoff mechanism cuts off the air supply to the air motor driving the tool, and thus automatically shuts off the tool, when the pressure in the pressure leading path exceeds a predetermined value. The present invention permits control of pulsed torque with high precision in a simple construction.

4 Claims, 4 Drawing Sheets

CONTROL UNIT FOR HYDRAULIC IMPACT WRENCH

This application is a continuation of PCT/JP99/00858 filed Feb. 24, 1999.

BACKGROUND OF THE INVENTION

The present invention relates to a control unit for a hydraulic impact wrench. More particularly, the present invention relates to a control unit for a hydraulic impact wench where a pulsed torque is controlled with high precision. Even more particularly, the present invention relates to a control unit that permits particularly simple construction.

Referring to FIG. 4, a conventional control unit for an impact wrench includes a cylinder casing 51 containing a main shaft 52. Cylinder casing 51 is rotatively driven by an air motor (not shown). The distal end of main shaft 52 is adapted to be engage members to be torqued. An oil cylinder 53, is formed inside cylinder casing 51. The sectional contour of oil cylinder 53 consists of a pair of two circular arcs whose centers are displaced to slightly eccentric positions from the rotational center of main shaft 52. The two circular arcs are aligned with each other to form a generally elliptical configuration. Sealed portions 53*a*, 53*b*, 53*c*, and 53*d* are defined at substantially quadrisected positions on the inner circumferential surface of the oil cylinder 53. Sealed portions 53*a*, 53*b*, 53*c*, and 53*d* extend along the axial direction of the oil cylinder. Oil cylinder 53 is filled with hydraulic operating fluid (not shown). A proximal end portion of main shaft 52 is disposed in the oil cylinder 53 perpendicular to the plane of the drawing sheet of FIG. 4.

A blade groove 54, is defined by the site corresponding to the disposition of the proximal end portion of the main shaft 52 and the oil cylinder 53. A pair of blades 55, 55 are placed slidably in the blade groove 54.

Referring to FIG. 5, a spring 56 energizes blades 55,55 outwardly in the diametrical direction thereof to move the distal end portions of blades 55,55 into slidable contact with the inner circumferential wall of the oil cylinder 53. Seal portions 52*a* and 52*b* in the main shaft 52 are formed at positions perpendicular to the respective blades 55, 55.

Referring now also to FIG. 4, when cylinder casing 51 is rotatively driven by an air motor a relative rotating position, defined between the main shaft 52 and the oil cylinder 53, changes. When respective seal portions 52*a*, 52*b* of the main shaft, and the distal ends of respective blades 55,55, are in contact with the respective seal portions 53*a*, 53*b*, 53*c*, and 53*d*, a position shown in FIG. 5 is reached. When the position shown in FIG. 5 is reached, hydraulic operating fluid, contained on either side of the respective blades 55, 55, defines a high pressure chamber H. Low pressure chamber L, not containing hydraulic operating fluid, is defined opposite the high pressure chamber H with respect to blades 55, 55. The low pressure chamber L has a lower pressure than the high pressure chamber H. Containment of the hydraulic operating fluid produces a pulse of high pressure that rotatively acts upon a main shaft 52 to apply a pulsed torque condition to a member to be torqued. The same condition for the containment of hydraulic operating fluid, as described above, appears where the cylinder casing 51 rotates 180 degrees from the position shown in FIG. 5.

A bypass mechanism is arranged so that one torque pulse is produced per rotation of the cylinder casing 51. The communication path mechanism communicates pressure from high pressure chamber H to low pressure chamber L only under conditions where respective seal portions 53*b*, 53*d*, 52*a*, and 52*b* are in contact with each other.

After the high pressure chamber H and the low pressure chamber L are defined in the oil cylinder 53, a portion of the high pressure hydraulic operating fluid contained in the high pressure chamber H must be bypassed to the lower pressure chamber L to release cylinder casing 51 for further rotation. A bypass passage 57 is defined in the cylinder casing 51 for this purpose. A valve shaft insertion hole 58, is bored on the cylinder casing 51 facing the bypass passage 57. An adjustable valve shaft 59 is inserted into the insertion hole 58.

A communication path 60 on the valve shaft 59 allows hydraulic operating fluid to penetrate the bypass passage 57. The communication path 60 functions as a variable aperture where the flow passage area of communication path 60 changes through axial adjustment of valve shaft 59. The peak pressure pulse in high pressure chamber H is controlled by the adjustment of the flow passage area. Thus the pulsed torque is controlled by varying the flow passage area of the communication path 60. When the flow passage area is reduced, high peak pressure is produced and a high pulsed torque is obtained for the hydraulic pulse generation mechanism.

A mechanism for stopping automatically the operation of the hydraulic pulse generation mechanism when a predetermined pulsed torque is obtained includes a relief valve 61 mounted on a shaft end portion on the distal side of the valve shaft 59. Relief valve 61 includes a ball 62 which is pressed by a spring 63 into contact with a shaft end surface of valve shaft 59. Hydraulic operating fluid in communication path 60, acts upon ball 62 through a pressure leading path 64, defined in a shaft center portion of valve shaft 59, so that pressure opposes the force of spring 63.

A secondary side of relief valve 61 communicates with a cylinder chamber 65 on a top cover. A piston 66 is contained inside cylinder chamber 65. An automatic shut off mechanism (not shown) is operated by a movement of a piston 66 upon a rod 67.

As a result, during operation when a predetermined peak pressure is produced in the high pressure chamber H and hydraulic operating fluid in communication path 60 exceeds a predetermined pressure, relief valve 61 is opened against the force of spring 63. Thus, the hydraulic operating fluid is released to flow into the cylinder chamber 65 to push a piston 66 and operate the automatic shut off mechanism through rod 67. This ends the operation.

Pulsed torque in the hydraulic pulse mechanism is generated when valve shaft 59 is transferred axially to adjust the flow path area of communication passage 60. At the same time valve shaft 59 adjusts the spring force of spring 63 in relief valve 61.

When the pulsed torque is increased, valve shaft 59 is translated to the right side of FIG. 5 thus increasing the opening of the aperture in communication path 60. This increases the peak pressure of hydraulic operating fluid produced in high pressure chamber H. Simultaneously, spring 63 of relief valve 61 is compressed to set the relief pressure to a high value.

The pulsed torque is influenced by two related values, the peak pressure of a hydraulic operating fluid in high pressure chamber H, and the spring force in relief valve 61. When the peak pressure and the spring force repeat with the same characteristics as that of the original response to transfer of valve shaft 59 an operator achieves a similar torque. In a conventional hydraulic impact wrench, the peak pressure and the spring force are correlative but do not vary with quite the same characteristics. In hydraulic impact wrench operations where the spring force is more that the increase in peak pressure, relief valve 61 may not operate and thereby cause inconvenience to operators. In hydraulic impact wrench operations where a sufficient peak pressure is obtained, relief valve 61, may open before a predetermined peak pressure is obtained if a sufficient spring force is not achieved. This results in less than the desired torque for the operator.

Conventional pulse generation mechanisms are particularly disadvantaged by very high dimensional accuracy requirements and close attention to manufacturing and assembly details to achieve the desired precision torque control and reduce persistent failures to operate. Manufacturing and assembly details, for conventional pulse general mechanisms, require close attention to the selection of force constant in spring 56, the dimensional accuracy of valve shaft 59 and the assembly of respective members.

OBJECTS AND SUMMARY OF THE INVENTION

It is an object of the invention to provide a hydraulic impact wrench control unit structure that overcomes the foregoing problems.

It is a further object of the invention to provide a control unit where a fixed aperture is disposed at a position located nearer to a high pressure chamber than a branched section of a pressure leading path.

It is a further object of the invention to provide a control unit where a fixed aperture is disposed at a position located on a side nearer to a low pressure chamber than a branched section of a pressure leading path According to an embodiment of the invention, there is provided a hydraulic impact wrench control unit comprising: a bypass passage, the bypass passage is defined between a high pressure chamber and a low pressure chamber, a pressure leading path is branched halfway through the bypass passage, a fixed aperture is disposed at a position located nearer to the high pressure chamber that a branched section of the pressure leading path, the pressure leading path is connected to a primary side of a relief valve, an automatic shut off mechanism is connectively linked by relieved hydraulic operating fluid that is disposed on a secondary side of the relief valve, the automatic shut off mechanism is constructed such that air supply to an air motor is stopped upon operation of the automatic shutoff mechanism, a relief pressure regulating means for regulating a relief pressure in the pressure relief valve is disposed between a primary side and a secondary side of the relief valve.

According to another embodiment of the invention, there is provided a a control unit further comprising: a fixed aperture , the fixed aperture being disposed at a position located on a side nearer to a low pressure chamber than a branched section of a pressure leading path is a bypass passage.

The above, and other objects, features and advantages of the present invention will become apparent from the following description read in conjunction with the accompanying drawings, in which like reference numerals designate the same elements.

DETAILED DESCRIPTION OF INVENTION

Figure 1:
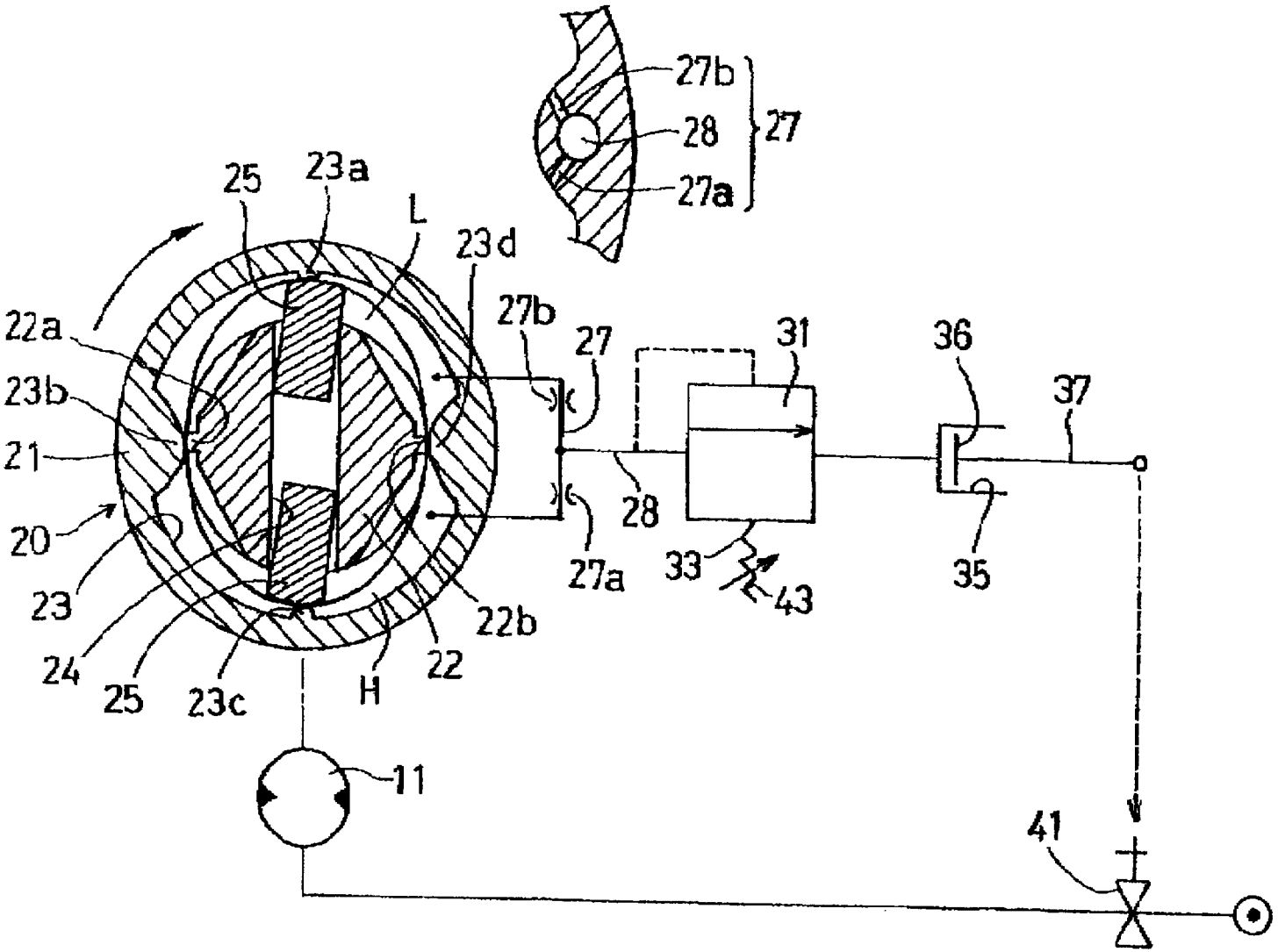
FIG. 1 is a schematic diagram showing a control unit for a hydraulic impact wrench according to an embodiment of the present invention.
Figure 2:
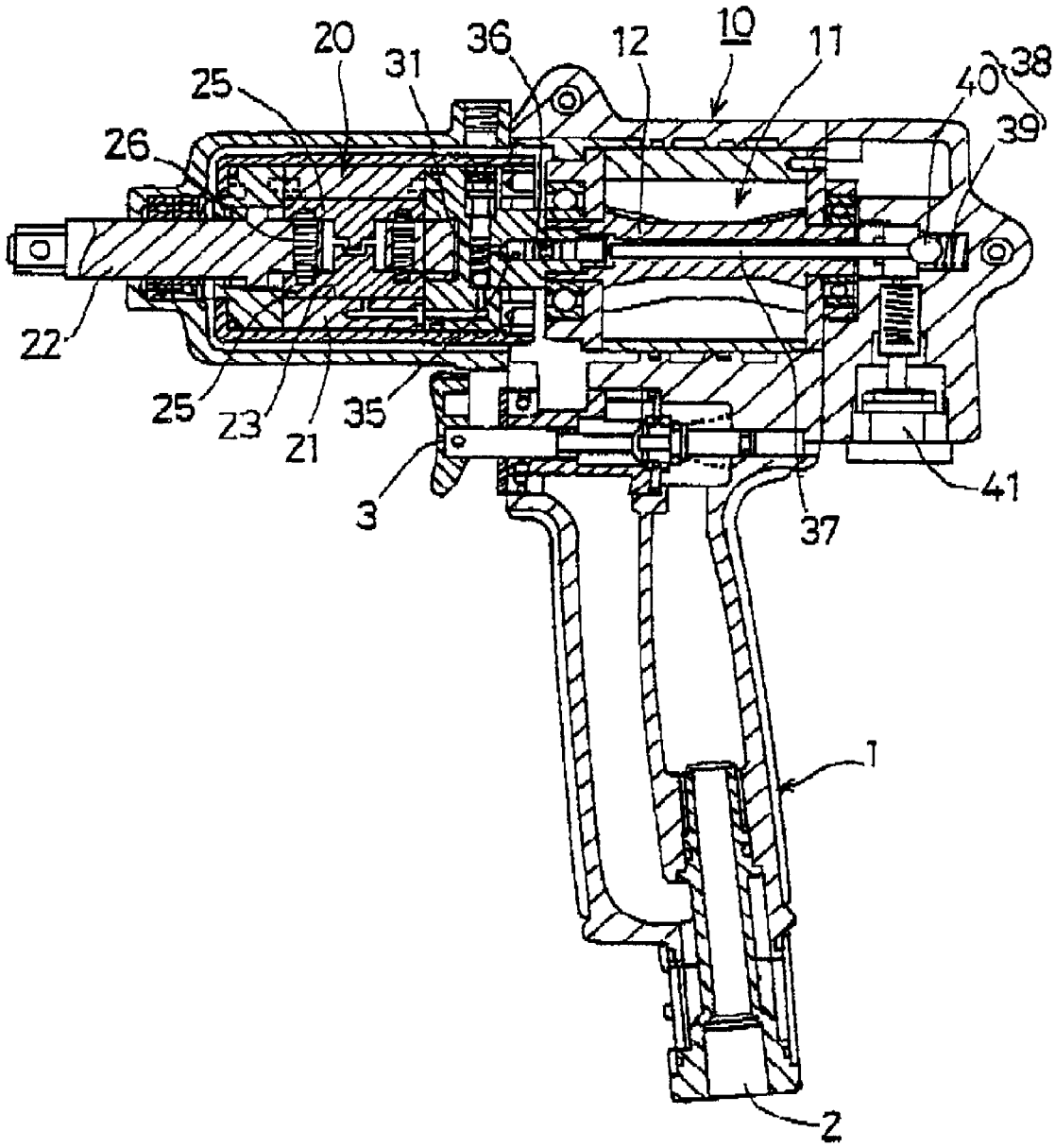
FIG. 2 is a whole sectional view, in longitudinal sectional, showing an embodiment of the control unit for hydraulic impact wrench of FIG. 1.

Referring to FIGS. 1 and 2, a hydraulic impact wrench, shown generally at 100, includes a grip section 1 and a main body casing 10, extending in a horizontal direction on the upper end of grip section 1. Grip section 1, contains an air intake port 2, and operating lever 3. The rear side portion of main body casing 10 contains a vane type air motor 11. A front side portion of main body casing 10 contains a pulsed torque generating mechanism 20 driven by rotor 12 of air motor 11. A main shaft 22 extends from the extreme end portion of main body casing 10 to an attachment section for an attachment (not shown) on the distal end.

Pulsed torque generating mechanism 20 may be similar to a conventional mechanism containing a cylinder casing 21 and main shaft 22. Cylinder casing 21 is rotatively driven by rotor 12 of air motor 11. Cylinder casing 21 forms hydraulic operating fluid cylinder 23. A sectional contour of oil cylinder 23, as shown in FIG. 1, describes a pair of circular arcs juxtaposed with centers displaced to slightly eccentric positions from the rotation center of main shaft 22 and smoothly aligned to each other forming an elliptical configuration.

Sealed portions 23*a*, 23*b*, 23*c*, and 24*d*, extending along the axial direction of oil cylinder 23, are defined at substantially quadrisected positions on the inner circumferential surface of oil cylinder 23. Oil cylinder 23 is filled with a hydraulic operating fluid.

Figure 3:
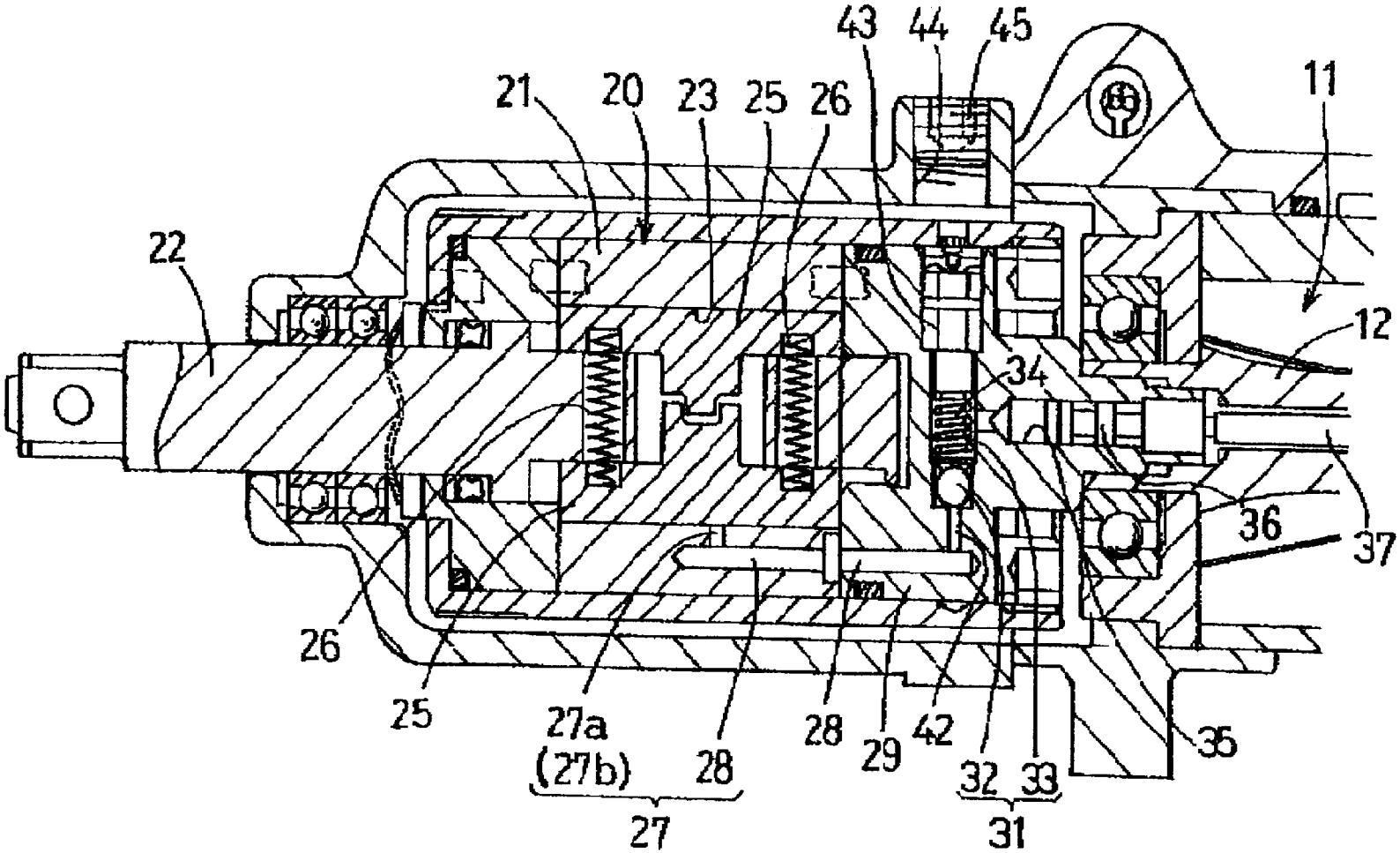
FIG. 3 is a partial sectional view, in the longitudinal section, showing an essential part of the control unit for hydraulic impact wrench of FIG. 2.
Figure 4:
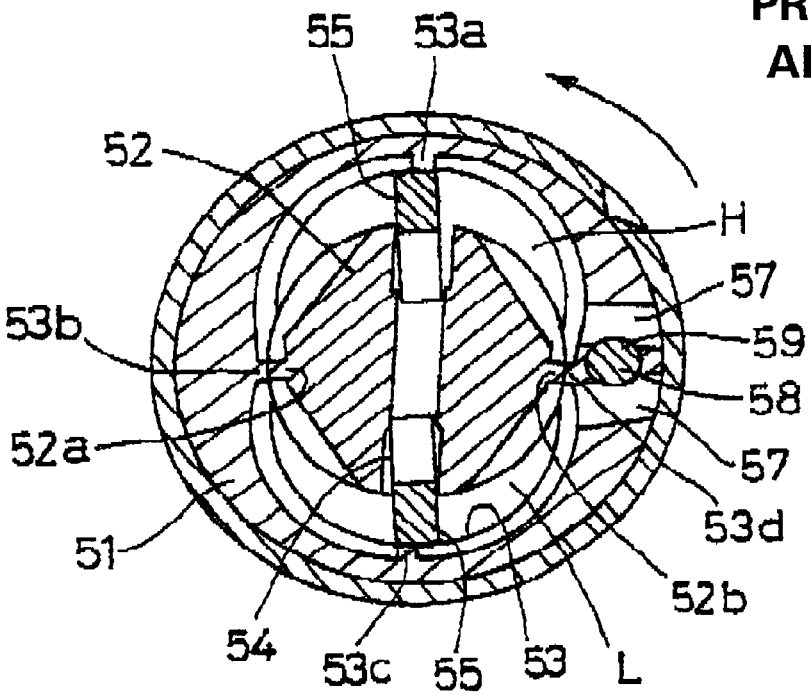
Fig. 4 PRIOR ART
FIG. 4 is a cross-sectional view showing a conventional control unit for hydraulic impact wrench.
Figure 5:
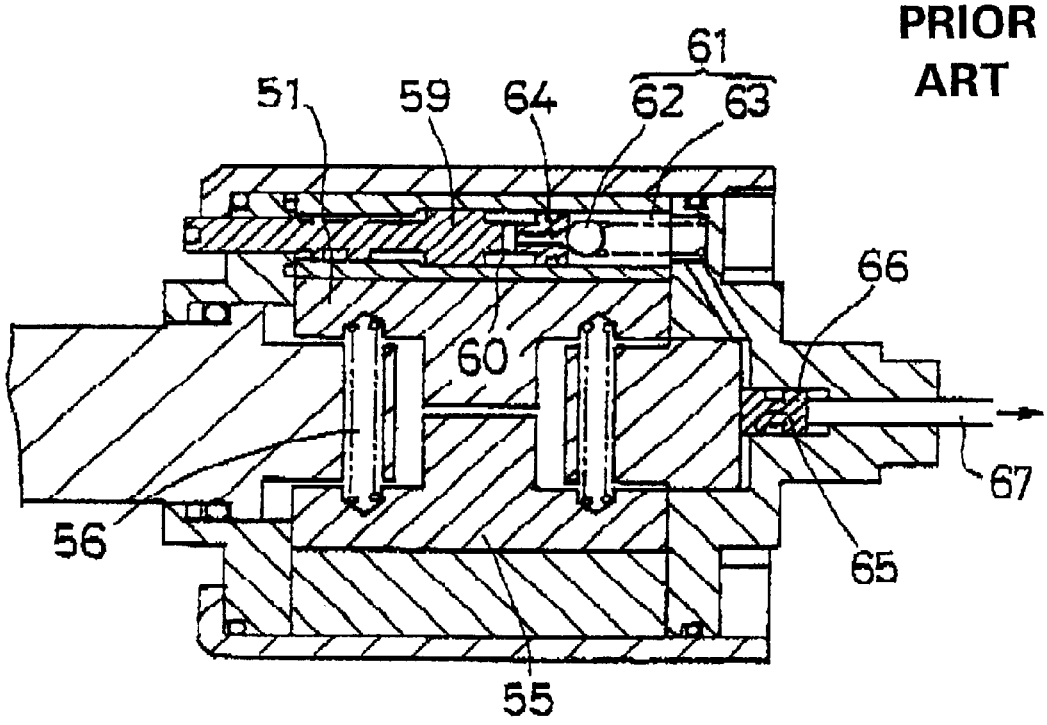
Fig. 5 PRIOR ART
FIG. 5 is a sectional view, in the longitudinal section, showing the conventional control unit for a hydraulic impact wrench.

Referring now also to FIG. 3, a proximal end portion of main shaft 22 is inserted in and disposed on oil cylinder 23. A blade groove 24, is defined by the site corresponding to the disposition of the proximal end portion of main shaft 22 and oil cylinder 23. A pair of blades 25, 25 are placed slidably in blade groove 24. Blades 25, 25 are energized by spring 26 to project outwardly in a diametrical directions. The extreme end portions of respective blades 25, 25 are in slidable contact with the inner circumferential wall of oil cylinder 23. Seal portions 22*a* and 22*b* are disposed at right angles to blades 25, 25. As seal portions 22*a* and 22*b* on main shaft 22 come into contact with seal portions 23*b* and 23*b*, blades 25 and 25 are urged into contact seal portions 23*a* and 23*c* of oil cylinder 23.

Referring specifically to FIG. 1, when cylinder casing 21 is rotated by air motor 11, a relative rotating position, defined between main shaft 22 and oil cylinder 23 is reached. The respective seal portions 22*a*, 22*b* and distal portions of respective blades 25,25 reach a position where all portions are in contact with respective seal portions 23*a*, 23*b*, 23*c*, and 23*d*, of oil cylinder 23. Hydraulic operating fluid is allowed to flow to both sides of respective blades 25, 25 to define a high pressure chamber H. Low pressure chamber L is defined opposite high pressure chamber H by respective to blades 25, 25. Low pressure chamber L contains a lower pressure than the pressure in high pressure chamber H. Pulsed high pressure torque is produces by the periodic containment of the hydraulic operating fluid, as described above. The pulsed high pressure acts upon the main shaft 22 to apply pulsed torque to a member to be torqued. It is to be noted that the torque pulse is generated once per rotation of cylinder casing 21, the same as in a conventional hydraulic impact wrench.

As shown in FIG. 3, bypass passage 27 communicates fluid between high pressure chamber H and low pressure chamber L. Bypass passage 27 is composed of a pair of fixed apertures 27*a*, 27*b* and part of pressure leading path 28. Pressure leading path 28 extends along the axial direction of cylinder casing 21. Fixed aperture 27*a*, having a diameter small enough to restrict flow therethrough, communicates between pressure leading path and high pressure chamber H. Fixed aperture 27*b*, also having a diameter small enough to restrict flow therethrough communicates pressure between leading path 28 and low pressure chamber L. Pressure leading path 28 leads to a top cover 29 of oil cylinder 23. Pressure leading path 28 is connected to a primary side of a relief valve 31 inside top cover 29. Relief valve 31 includes a ball 32 and a spring 33. Ball 32 is resiliently urged into contact with an opening of pressure leading path 28 by the spring constant of spring 33.

A cylinder chamber 35 is defined at the shaft center position of the top cover 29 of oil cylinder 23. Cylinder chamber 35 is communicated with a secondary side of relief valve 31. Cylinder chamber 35 communicates with a spring chamber 34 containing spring 33. A piston 36 is slidably disposed in cylinder chamber 35. A rod 37 is connected to piston 36. Rod 37 passes through the shaft center portion of rotor 12 of air motor 11. Rod 37 extends to the rear end portion of hydraulic impact wrench 100.

As shown in FIG. 2, rear end portion of rod 37 abuts a ball valve 38. Ball valve 38 urges a ball 40 and rod 37 toward the extreme end of hydraulic impact wrench 100. Ball valve 38 is opened by forcible movement of ball 32 against the force of spring 39, thereby supplying air to automatic shutoff mechanism 41. This operates automatic shutoff mechanism 41.

As shown in FIG. 3, relief valve 31 includes primary port 42, ball 32, and spring 33, aligned with each other in the diametrical direction in top cover 29. Spring 33 is pressed against primary port 42 by a relief pressure regulating means 43. Relief pressure regulating means 43 regulates relief pressure. Relief pressure regulating means 43 is free to advance and retreat in the diametrical direction in top cover 29. Relief pressure regulating means 43 is adjustable from outside top cover 29 by tightening to increase relief pressure or loosening it to reduce relief pressure, both by changing the force applied by spring 33. Access for adjustment of regulating means is provided by removing removable stopper 45 from operating hole 44. In this manner, torque is adjusted by adjusting the relief pressure controlled by relief valve 31.

When air motor 11 is rotated by operating a control lever, cylinder casing 21 rotates. A pulse of torque is generated once per rotation of cylinder casing 21, so that members to be torqued such as bolts, and nuts are torqued. During operation, the peak pressure produced in the high pressure chamber H, and the peak pressure in pressure leading path 28 both increase simultaneously. When peak pressure exceeds a predetermined value of pressure, relief valve 31 is opened against the force of spring 33. Piston 36 in cylinder chamber 35 is forcibly moved by hydraulic operating fluid relieved into spring chamber 34. Thus, transfer of rod 37, opening of ball valve 38, and operation of automatic shutoff mechanism 41 are carried out in order, and air supply to air motor 11 is stopped by operation of automatic shutoff mechanism 41, so that torque generation is stopped automatically. As described, operation is automatically stopped, in the above described hydraulic impact wrench, when the peak pressure in high pressure chamber H exceeds a predetermined value of pressure. This effects the generation of a constant impact torque.

Referring to FIG. 3, in the hydraulic impact wrench, a spring force of spring 33 in relief valve 31 is adjusted for changing a setting the value of pulsed torque. More specifically, the position relief pressure regulating means 43 is screwed in or out to adjust the force on spring 33. As a result, the pressure point at which relief valve 31 operates is adjusted.

In the prior art hydraulic impact wrench, two characteristic properties are adjusted. These properties are the peak pressure produced in high pressure chamber H and the relief pressure. In the present invention, only the relief pressure requires adjustment by adjusting the pressure setting of relief valve 31. Accordingly, pulsed torque is controlled in the present invention with high precision and in a simple structure.

Having described preferred embodiments of the invention with reference to the accompanying drawings, it is to be understood that the invention is not limited to those precise embodiments, and that various changes and modifications may be affected therein by one skilled in the art without departing from the scope or spirit of the invention as defined in the appended claims. For example, although the above description, operates automatic shutoff mechanism 41 by operating piston 36, rod 27 of relief valve 31, any of other suitable technique may be substituted therefore without departing from the spirit and scope of the invention.

What is claimed is:

1. A hydraulic impact wrench comprising:

an air motor;

a pulsed torque generating mechanism driven by said air motor;

said pulsed torque generating mechanism including a cylinder casing and a main shaft;

one of said cylinder casing and said main shaft being rotatively driven by said air motor;

the other of said cylinder casing and said main shaft including means for engaging a member to be torqued;

an oil cylinder disposed in said cylinder casing filled with a hydraulic operating fluid;

a blade mounted on said main shaft;

said blade being relatively rotatable inside said oil cylinder;

a high pressure chamber (H) for containing said hydraulic operating fluid;

said high pressure chamber (H) being located at a specific position in the rotating direction of the oil cylinder;

said high pressure chamber (H) being present on both sides of said blade;

a low pressure chamber (L) having a lower pressure than that of the high pressure chamber (H) is located on the opposite side of the blade, whereby a pulsed torque is applied to the member to be torqued;

a bypass passage for communicating fluid pressure between said high pressure chamber (H) and said low pressure chamber (L);

a pressure leading path including first and second branch passages along said bypass passage;

said first branch passage being a fixed aperture from said pressure leading path to said high pressure chamber (H);

said second branch passage being a fixed aperture from said pressure leading path to said low pressure chamber (L);

a relief valve;

a connection between said pressure leading path and a primary side said relief valve;

an automatic shutoff mechanism; and said automatic shutoff mechanism including means responsive to a pressure at said primary side of said relief valve exceeding a predetermined value for cutting off an air supply to said air motor.

2. A hydraulic impact wrench according to claim 1, further comprising:

said second branching passage includes a second fixed aperture at a position on a side of said pressure leading path nearer to said low pressure chamber (L).

3. A pulsed torque generating mechanism for a hydraulic impact wrench, comprising:

an air motor;

a pulsed torque generating mechanism driven by said air motor;

said pulsed torque generating mechanism including a cylinder casing and a main shaft;

one of said cylinder casing and said main shaft being rotatively driven by said air motor;

the other of said cylinder casing and said main shaft including means for engaging a member to be torqued;

an oil cylinder disposed in said cylinder casing filled with a hydraulic operating fluid;

at least one blade on said main shaft;

said blade being relatively rotatable inside said oil cylinder;

a high pressure chamber (H) containing said hydraulic operating fluid;

said high pressure chamber (H) being present on both sides of said blade;

a low pressure chamber (L) containing said hydraulic fluid having a lower pressure than that of the high pressure chamber (H);

said low pressure chamber (L) being located on the opposite side of the blade, whereby a pulsed torque is applied to the member to be torqued;

a first aperture leading from said high pressure chamber (H) to a relief valve;

a second aperture leading from said low pressure chamber (L) to said relief valve; and said relief valve being responsive to a fluid pressure applied thereto exceeding a predetermined value for cutting off application of air pressure to said air motor, and thereby terminating operation of said impact wrench.

4. A pulsed torque generating mechanism for a hydraulic impact wrench, comprising:

an air motor;

a pulsed torque generating mechanism driven by said air motor;

an oil cylinder substantially filled with a hydraulic operating fluid;

a blade mounted on said main shaft;

said blade being relatively rotatable inside said oil cylinder;

a high pressure chamber (H) in said oil cylinder;

said high pressure chamber (H) being located at a specific position in the rotating direction of said oil cylinder on both sides of said blade;

a low pressure chamber (L) having a lower pressure than that of the high pressure chamber (H) located on an opposite side of the blade;

a relief valve;

a first restricted passage from said high pressure chamber (H) to an input of said relief valve;

a second restricted passage from said low pressure chamber (L) to said input of said relief valve;

an automatic shut off mechanism; and said automatic shutoff mechanism includes means responsive to a pressure as said primary side of said relief valve exceeding a predetermined value for cutting off an air supply to said air motor.

* * * * *